US008191292B2

(12) United States Patent
Cummings et al.

(10) Patent No.: US 8,191,292 B2
(45) Date of Patent: Jun. 5, 2012

(54) RECOGNITION AWARD, PERSONNEL IDENTIFICATION HOLDER AND/OR PERSONNEL UNIT FOR ATTACHMENT TO HARDHATS, PROTECTIVE HELMETS OR THE LIKES

(76) Inventors: Timothy Alan Cummings, Hurst, TX (US); Joseph Nick Filadelfia, Jr., Fort Worth, TX (US)

( * ) Notice: Subject to any disclaimer, the term of this patent is extended or adjusted under 35 U.S.C. 154(b) by 0 days.

(21) Appl. No.: 11/448,209

(22) Filed: Jun. 7, 2006

(65) Prior Publication Data

US 2006/0272189 A1 Dec. 7, 2006

Related U.S. Application Data

(60) Provisional application No. 60/688,157, filed on Jun. 7, 2005.

(51) Int. Cl.
*G09F 3/00* (2006.01)

(52) U.S. Cl. ..... 40/329; 2/209.13

(58) Field of Classification Search ..... 40/329, 40/666, 641; 2/209.13
See application file for complete search history.

(56) References Cited

U.S. PATENT DOCUMENTS

| | | | | |
|---|---|---|---|---|
| 2,803,829 | A * | 8/1957 | Tscharner | 40/329 |
| 3,735,515 | A * | 5/1973 | Lagert | 40/641 |
| 5,170,535 | A * | 12/1992 | Strong | 24/67.9 |
| 5,548,847 | A * | 8/1996 | Spicijaric | 2/209.13 |
| 5,915,539 | A * | 6/1999 | Lack | 2/422 |
| 6,032,394 | A * | 3/2000 | Hand et al. | 40/651 |
| 7,093,305 | B2 * | 8/2006 | Reilly et al. | 2/209.13 |
| 2007/0017136 | A1 * | 1/2007 | Mosher et al. | 40/633 |

OTHER PUBLICATIONS

New ANSI Standard Head Protection Technical Bulletin.

* cited by examiner

*Primary Examiner* — Joanne Silbermann
(74) *Attorney, Agent, or Firm* — Schultz & Associates, P.C.

(57) ABSTRACT

A device for displaying a recognition award includes a hard hat having a pocket, a detachable connected holder to be placed in the pocket and a personnel unit adapted to display the recognition award and adapted to be positioned in the detachedly connected holder. The device is used as a recognition award or personnel identification unit to be retained within a detachedly connected holder.

4 Claims, 7 Drawing Sheets

RECOGNITION AWARD, PERSONNEL IDENTIFICATION HOLDER AND/OR PERSONNEL UNIT FOR ATTACHMENT TO HARDHATS, PROTECTIVE HELMETS OR THE LIKES

The present application claims priority under 35 USC section 119 based on provisional application 60/688,157 which was filed on Jun. 7, 2005.

FIELD OF THE INVENTION

The present invention relates to protective helmets and more particularly to a recognition award and/or personnel identification holder and recognition award and/or personnel identification unit for attachment to hardhats, protective helmets or the likes.

BACKGROUND OF THE INVENTION

Hardhats, safety helmets and protective helmets are common articles that are worn at construction sites. Furthermore, hardhats and protective helmets have a pocket slot so that accessories can be attached to the hardhats easily.

U.S. Pat. No. 6,616,294 to Henry discloses a hard hat mounted flashlight holder for use with the conventional hardhat to releasably receive a flashlight.

U.S. Pat. No. 4,764,989 to Bourgeois discloses a pair of strap retainers being mounted on opposite sides of a safety helmet for securing safety goggles in a storage position.

U.S. Pat. No. 6,904,147 to Lenz discloses a hard hat mount assembly for mounting a speaker device on the hardhat.

The above references are incorporated by reference in their entirety

In the prior art, recognition for individuals was usually accomplished by placing paper or plastic stickers with a backing of adhesive on the hard hat or protective helmet. The stickers are very inexpensive and did not necessarily show the appreciation or recognition for the user of the hard hat or protective helmet. Additionally, the stickers can be easily damaged and do not provide a lasting and a professional appearance to recognize the performance of the user. Furthermore, the stickers cannot be removed or updated without replacing the hard hat or protective helmet.

Alternatively, many companies use high quality awards such as label pins to recognize employees for superior performance, milestone time periods of service, milestone time periods of safe work etc. Particularly in industrial and construction applications, it is difficult to provide employees with recognition awards that they can wear daily and be proud of. Metal awards can be unsafe if worn in the workplace and easily damaged or destroyed by conditions in the workplace. ANSI standards to not allow attachment pins or other metal items to be placed on hard hats and protective helmets. Metal items worn on the head invite electrical shock hazards.

SUMMARY OF THE INVENTION

The present invention provides a method and detachability connected holder for attaching recognition awards and or personnel identifiers such as a RFID chip or the like to hard hats and protective elements utilizing an accessory slot or pocket on the hard hats and helmets and for removing the holder, and for the recognition award/personnel identification unit that is retained within the holder. The recognition award/personnel ID holder is nonconductive and allows the user to attach a variety of awards so that the user of the hardhat would be recognized for years of service, time work safely and other matters of performance.

The recognition award/personal identification unit can be made from plastic, metal, or other materials and can be stamped, engraved, painted or have other similar surfaces for customization. The unit can be installed with or without a clear plastic lens.

Another use for the user of the hardhat would be a detachable connected holder for identification, locating, tracking or finding the user utilizing a chip including a transmitter, microprocessor or other device which allows other individuals to track the user of the hardhat or protective helmet.

The present invention can be used with differing shapes, sizes and coloration in order to customize it for different company and industry needs.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

Figure 15:
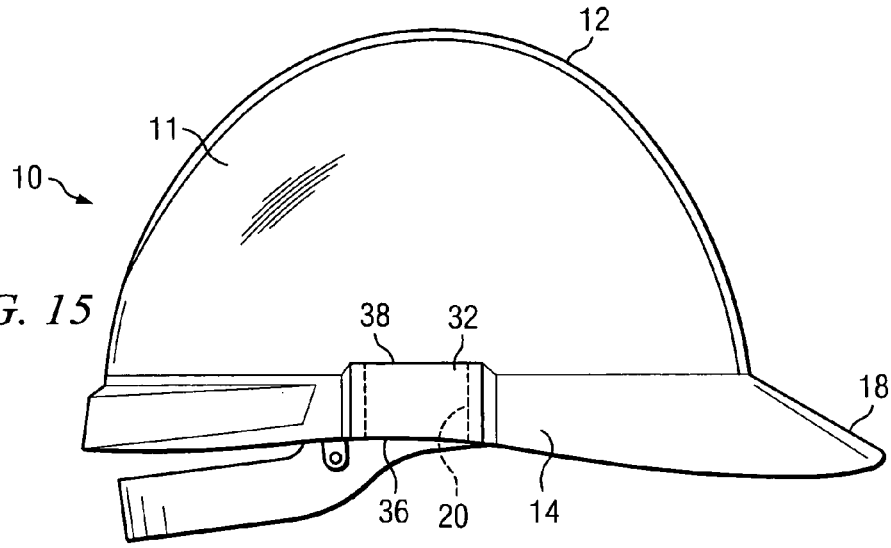
FIG. 15 illustrates a cross-sectional view of a hardhat with a pocket.

As shown in FIG. 15, safety helmets, protective hats or hardhats 10 are usually formed as a one-piece molded shell 11 of durable, high-impact material having a dome-shaped crown 12 which transitions into a radially-flared rim 14. A portion of the rim 14 is extended forwardly to define a protective visor 18. The visor 18 projects outwardly from the crown 12 for a substantially greater distance than from the side and back portions of the rim 14.

The pocket 20 or accessory slot is formed in the shell 11 on opposite sides of the helmet for receiving a detachedly connected holder 30. The pocket 20 may be bounded on one side by the shell 11 and on the other side by bracket panel 32. The bracket panel 32 is provided with a lower edge 36 and an upper edge 38 which define latching surfaces for interlocking engagement with the detachedly connected holder 30.

Figure 1:
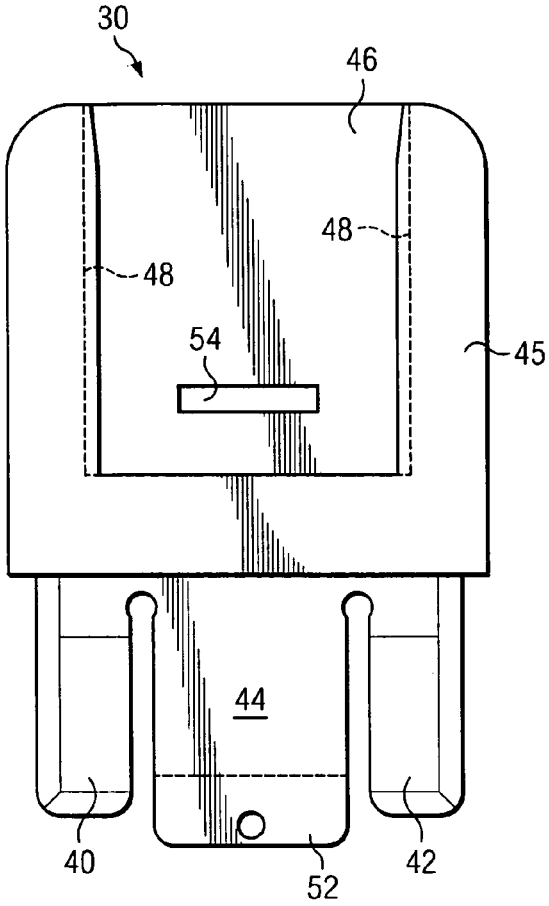
FIG. 1 illustrates a cross-sectional view of the detachedly connected holder of the present invention.

Referring now to FIG. 1, the detachedly connected holder 30 is provided with resilient guiding arms 40, 42 which project in a spaced relation from an elongated body member 45 to guide the guiding arms 40, 42 into the pocket 20 and is provided with an engaging arm 44 to engage and hold the detachedly connected holder 30 into the helmet. A depression 46 is formed in the elongated body member 45 and extends through the end of the elongated body member 45 which opposes the guiding arms 40, 42 and the engaging arm 44. A pair of open slots 48 is formed along the depression 46 of the body member 45. The engaging arm 44 includes an outwardly projecting retention catch 52 to engage the lower edge 36 of the pocket 20. The open slots 48 extend the length of the depression 46 in the longitudinal direction. The open slots 48 and the depression 46 accept an award or personnel unit 78 which may include indicia 74 for an award or personnel identification. The elongated body member 45 includes a centrally located detention slot 54 for accepting an outwardly projecting tab 76 positioned on the personnel unit 78 in order to retain the personnel unit 78 in the depression 46. Subsequently, the personnel unit 78 can be released from the detention slot 54 so that the personnel unit 78 can be replaced by a new personnel unit 78. Consequently, the personal unit 78 is detachedly connected to the detachedly connected holder 30. The engaging arm 44 deflects inwardly towards the hard hat 10 to provide spring pressure so that the detachedly connected holder 30 is retained within the pocket 20. The engaging arm 44 additionally includes a outwardly extending retention catch 52 to engage the lower edge 36 of the hard hat 10.

Figure 2:
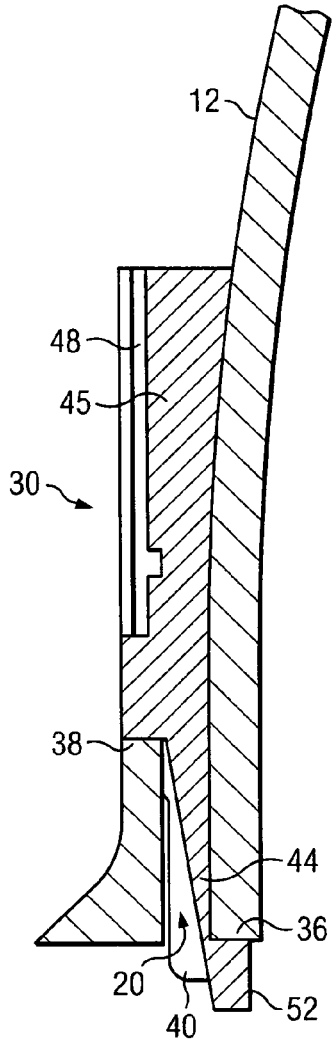
FIG. 2 illustrates a cross-sectional view of the side of the dome shape crown and detachedly connected holder.

FIG. 2 illustrates a cross-sectional view of the dome shape crown 12, the pocket 20, the guiding arms 40, the retention catch 52 and the engaging arm 44. The engaging arm of 44 is shown angled towards the dome shape crown 12 and the retention catch 52 positioned under the lower edge 36 of the pocket 20. FIG. 2 additionally shows that the front side of the detachable connected holder 30 is substantially flat, but the back side of the detachedly connected holder 30 is concavely curved to approximately correspond to the convexly curved surface of the dome shape crown 12.

Figure 3:
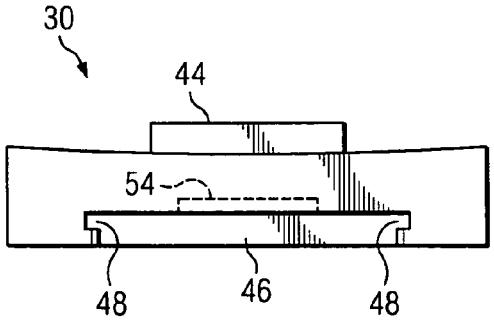
FIG. 3 illustrates a cross-sectional view of the top of the detachedly connected holder.

FIG. 3 illustrates a top view of the detachedly connected holder 30 which shows the open slots 48 on the sides of the depression 46 to accept the personnel holder 78.

Figure 4:
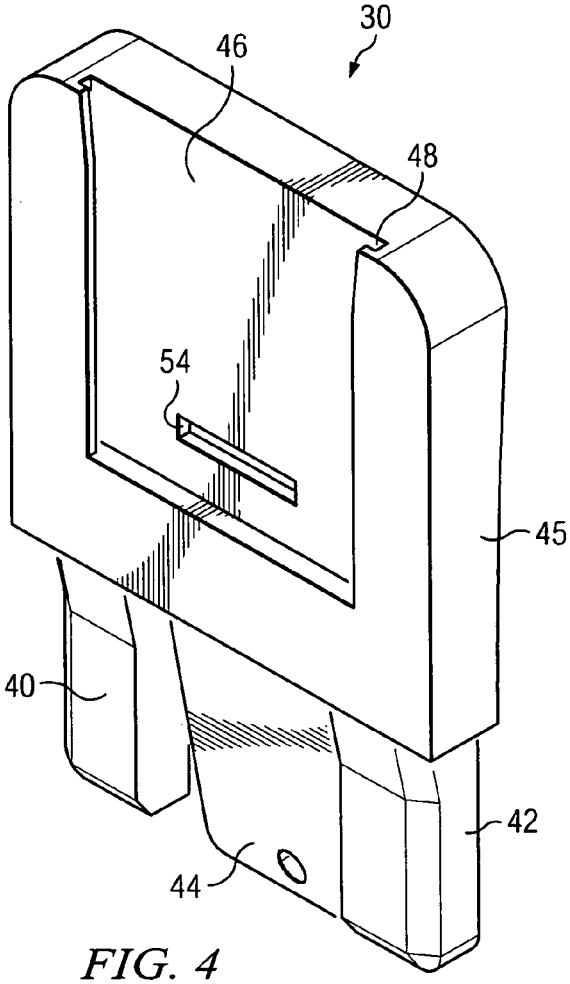
FIG. 4 illustrates a perspective view of the front of the detachedly connected holder.

FIG. 4 illustrates a perspective view of the front side of the detachedly connected holder 30. The engaging arm 44 is shown angled with respect to the guiding arms 40, 42. Additionally, the interior of the detention slot 54 is illustrated within the depression 46.

Figure 5:
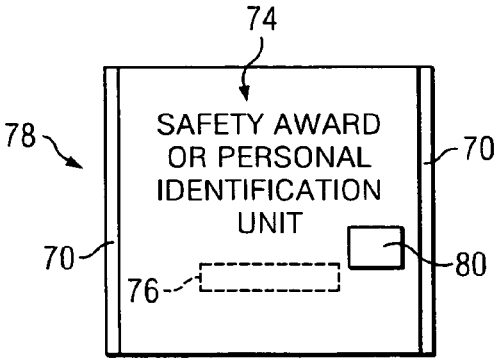
FIG. 5 illustrates a cross-sectional view of the front of the recognition award and/or personnel identification unit.

FIG. 5 illustrates a cross-sectional view of the front side of the personnel unit 78 which may be positioned within depression 46 of the detachedly connected holder 30. The vertical edges 70 of the personnel unit 78 have been reduced in dimension in order to more easily slide into the open slots 48 of the elongated body member 44. FIG. 5 additionally illustrates in phantom line the outwardly projecting tab 76 to engage the detention slot 54. The personnel unit 78 could include an identification chip 80 so that the location of the personnel unit 78 could be determined. Additionally, the personnel unit 78 could be marked with indicia 74 to indicate a safety award or other type of recognition that would be personal to the user of the personnel unit 78.

Figure 6:
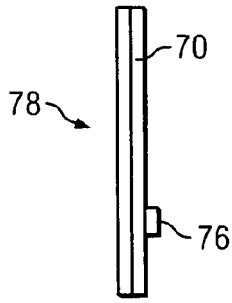
FIG. 6 illustrates a cross-sectional view of the side of the personnel unit.

FIG. 6 shows a cross-sectional view of the side of the personnel unit 78, shows the vertical edges 70 and shows the outwardly projecting tab 76. FIG. 6 shows the vertical edges 70 approximately in the center of the side of the personnel holder 78 extending from the top of the personnel holder 78 to the bottom of the personnel holder 78.

Figure 7:
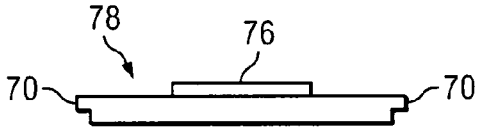
FIG. 7 illustrates a cross-sectional view of another embodiment of the personnel unit.

FIG. 7 shows a cross-sectional view of another embodiment of the top of the personnel unit 78. The vertical edges 70 are positioned towards the back side of the personnel unit 78 in order to project the personnel unit 78 towards the front side of the elongated body member 44. FIG. 7 additionally shows that the outwardly projecting tab 76 is positioned on the back side of the personnel unit 78.

Figure 8:
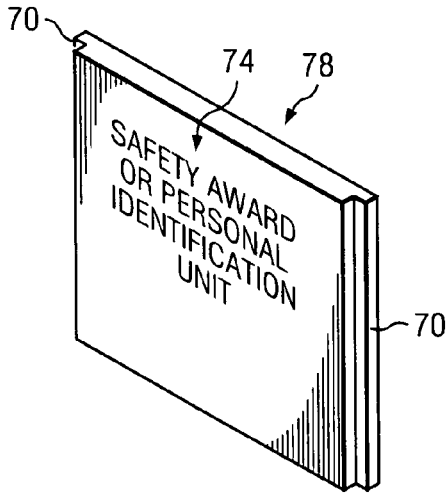
FIG. 8 illustrates a perspective view of another embodiment of the personnel unit.

FIG. 8 illustrates a perspective view of the embodiment shown in FIG. 7 and illustrates indicia 74 on the front side of the personnel unit 78.

Figure 9:
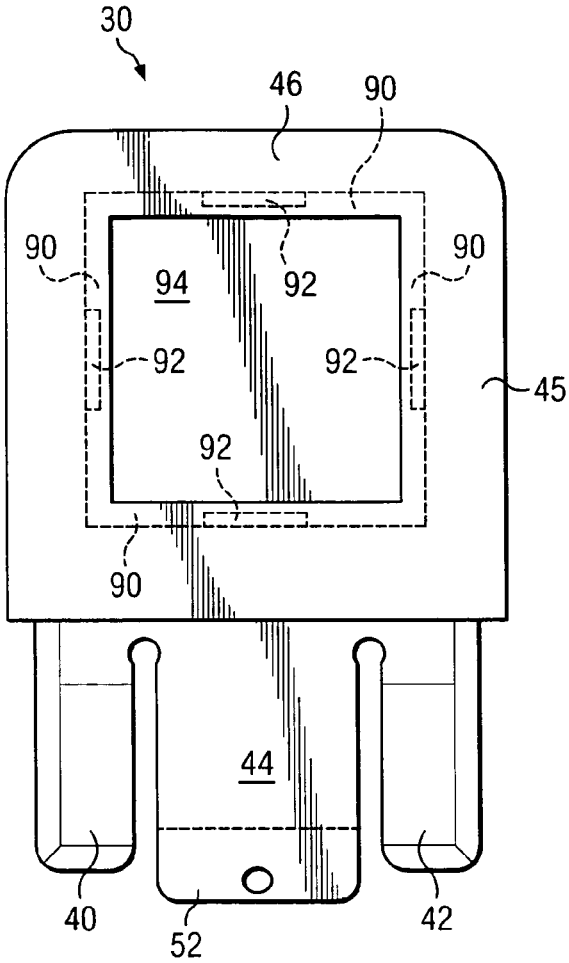
FIG. 9 illustrates a cross-sectional view of another embodiment of the detachedly connected holder.

FIG. 9 illustrates a cross-sectional view of another embodiment of the present invention. In this embodiment, the personnel unit 78 is positioned in approximately the center of the elongated body member 45 in order to the present the personnel unit 78 in a frame like environment. In this embodiment, the elongated body member 45 includes an aperture 94 which extends from the back of the elongated body member 45 to the front of the elongated body member 45. The elongated body member 45 includes a retention channel 90 which extends around the periphery of the aperture 94 and an inwardly projecting element 92 which extend from the retention channel 90 to hold the personnel holder 78 within the aperture 94. The aperture 94 may be covered by clear cover positioned on the front side of the elongated body member 44 in order to protect the personnel holder 78.

Figure 10:
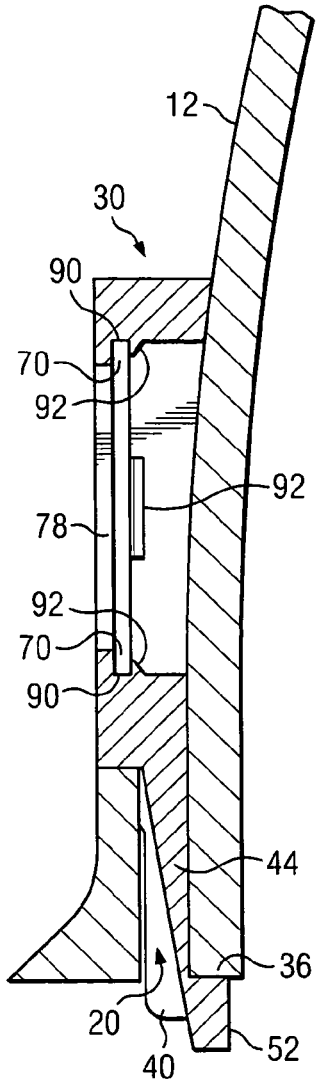
FIG. 10 illustrates a cross-sectional view of the dome shape crown, the detachedly connected holder and the personnel unit.

FIG. 10 illustrates a cross-sectional view of another embodiment of the dome shape crown 12 with the detachedly connected holder 30 and a personnel unit 78. The vertical edges 70 are positioned within the retention channel 90, and the inwardly projecting elements 92 are retaining the vertical edges 70.

Referring now to FIGS. 9 and 10, the engaging arm 44 is illustrated at an angle with respect to the guiding arms 40, 42 to provide spring pressure when inserted into the pocket 20, and the retention catch 52 latches the bottom edge 36 of the pocket 20. The back side of the detachedly connected holder 30 is concavely curved to approximately conform to the dome shape crown 12 which is convexly curved.

Figure 11:
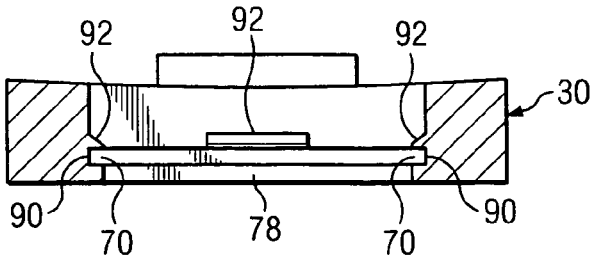
FIG. 11 illustrates a cross-sectional view of the top of the detachedly connected holder.

FIG. 11 illustrates a top view of the detachedly connected holder 30 in accordance with the teachings of the present invention. The personnel unit 78 is positioned by the vertical edges 70 positioned in the retention channel 90 and held by the inwardly projecting elements 92.

Figure 12:
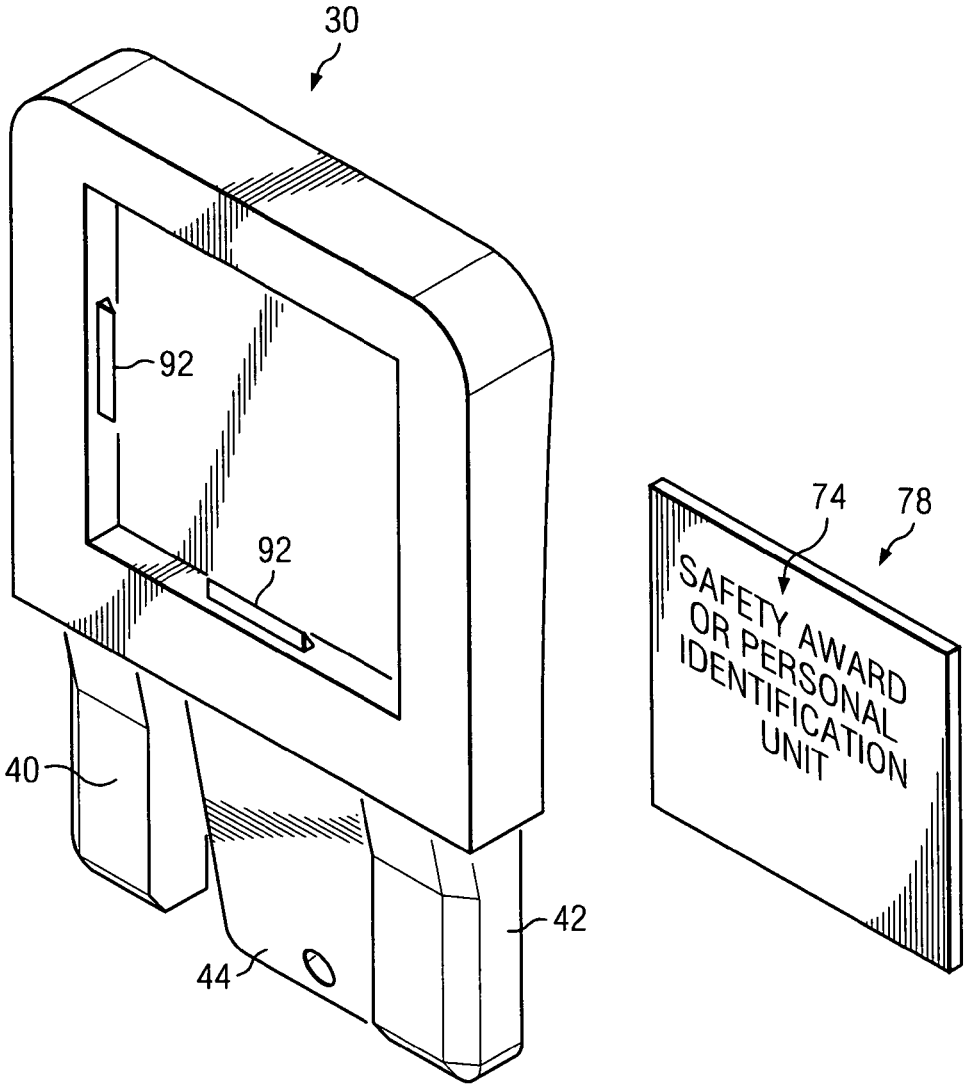
FIG. 12 illustrates an exploded perspective view of the detachedly connected holder and recognition award and/or personnel identification unit.

FIG. 12 illustrates a exploded perspective view and an alternate embodiment of the detachedly connected holder 30 and the personnel unit 78 with indicia 74. The detachedly connected holder 30 includes the guiding arms 40, 42 and the engaging arm 44 to detachedly connect the detachedly connected holder 30 in the pocket 20 of the hard hat 10. The elongated body member 45 includes inward projecting elements 92 to hold the personnel unit 78.

Figure 13:
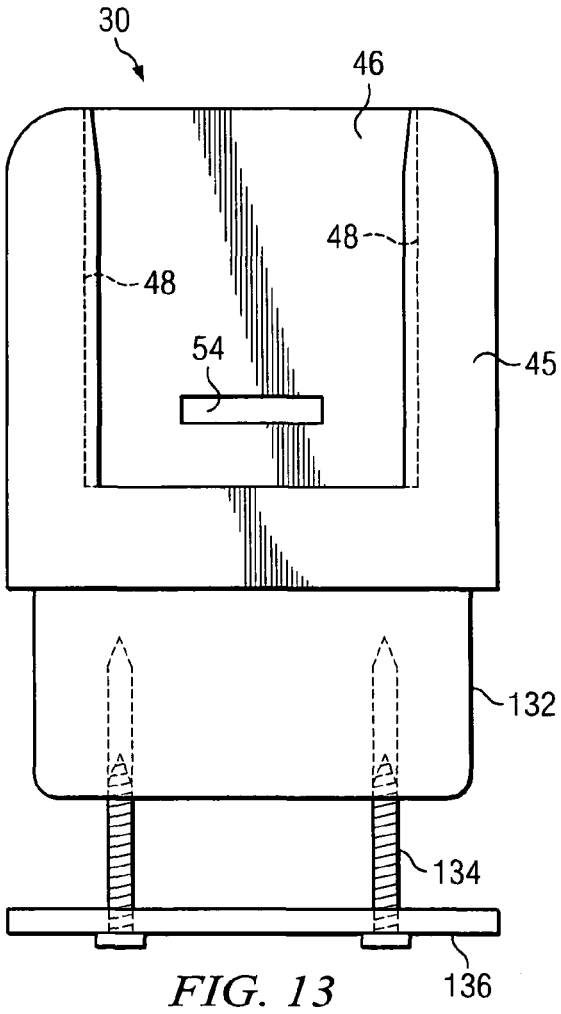
FIG. 13 illustrates a cross-sectional view of an alternate embodiment of the detachedly connected holder of the present invention.

FIG. 13 illustrates a cross-sectional view of an alternate embodiment of the present invention. Similarly to FIG. 1, the elongated body member 45 includes a depression 46 a detention slot 54, the open slot 48. Additionally, the elongated body member 45 illustrated in FIG. 9 could equally be incorporated into the embodiment illustrated in FIG. 13. The elongated body member 45 is mounted on a elongated body base 132 which may be formed from plastic, wood, metal and which may be a substantially solid housing for connection to the pocket 20 by virtue of attachment base 136. The elongated body base 132 is connected to the attachment base 136 by one or more fastening devices which may be screws, bolts, nuts, glue, Velcro or any other suitable device. The attachment base 136 may be positioned under the pocket 20 and positioned against the lower edge 36 of the pocket 20 while the elongated body member 24 is positioned against the upper edge 38 of the pocket 20.

Figure 14:
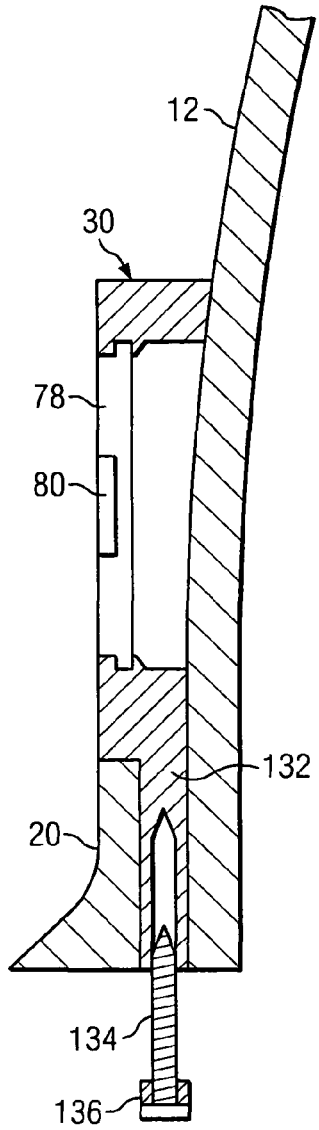
FIG. 14 illustrates a cross-sectional view of an alternate embodiment of the detachedly connected holder and the dome shape crown.

FIG. 14 illustrates a cross-sectional view of the detachedly connected holder 30 that has been connected to the dome shaped crown 12 by virtue of the pocket 20. The elongated body base 132 is connected to the attachment base 136 by virtue of fastening device 134. The embodiment illustrated in FIG. 14 should with more securely attach the detachedly connected holder 30 but may necessitate the use of tools in order to connect the fastening device 134.

The personnel unit 78 and the detachedly connected holder 30 may be constructed a non-conductive plastics and these are molded using injection methods. The detachedly connected holder 30 is inserted into a pocket 20 provided on hardhats 10 as described hereinabove which allows for quick attachment and removal of the detachedly connected holder 30. The personnel unit 78 slides into a depression 46 in the elongated body member 45 or may be attached into the aperture 94 of the elongated body member 45. The personnel unit 78 may include indicia 74 in the form of a recognition award or may include chip 80 to broadcast a signal so that the location of the user can be identified.

Figure 16:
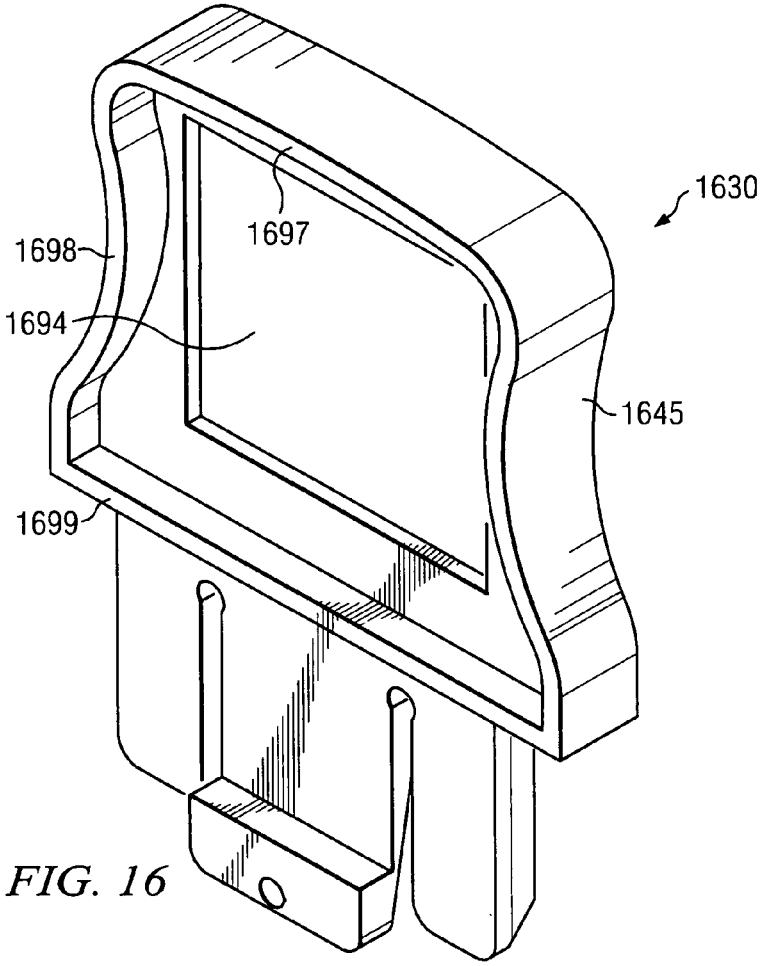
FIG. 16 illustrates a perspective rear view of another embodiment of the detachedly connected holder.

FIG. 16 illustrates a rear perspective view of an alternate embodiment of the detachedly connected holder 1630 which includes a curved elongated body member 1645. The curved elongated body member includes an aperture 1694 positioned approximately in the center of the front side 1696 of the curved elongated body member 1645 to provide an adhesive ledge for retaining the award/identification unit in the rear-view. A side edge 1698, a top edge 1697 and a bottom edge 1699 define the front side 1696 which defines the periphery of the aperture 1694.

Figure 17:
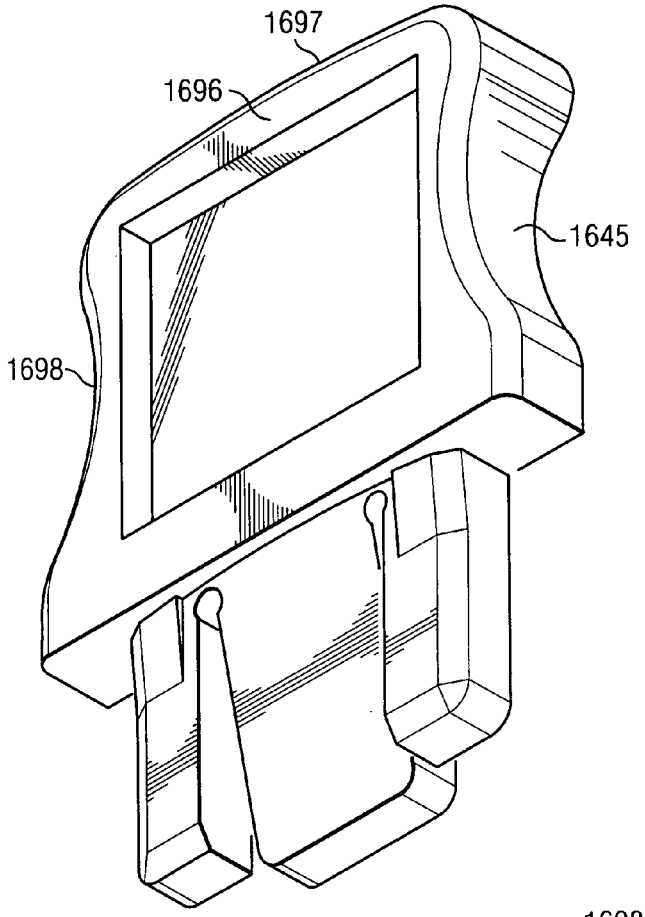
FIG. 17 illustrates a perspective view of the front side of an alternate embodiment of the detachedly connected holder.

FIG. 17 shows a perspective front view of the curved elongated body member of 1645 including the front side 1696, the top edge 1697 and the side edge 1698.

Figure 18:
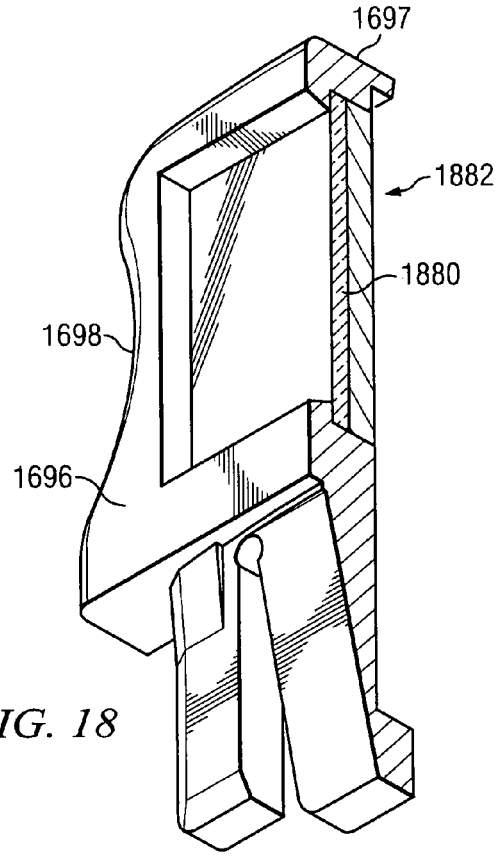
FIG. 18 illustrates a perspective cutaway view of the front side of an alternate embodiment of the detachedly connected holder.

FIG. 18 shows a cutaway view of the detachedly connected holder 1630 with a protective lens 1880 which may be formed of clear plastic and attached to the detachedly connected holder 16 30 with adhesive. The protective lens 1880 is positioned against the front side 1696. The personnel unit 1882 is positioned behind the protective lens 1880 and secured in place with adhesive.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. An apparatus for displaying a message comprising:

a hat having a rigid rim;

the rigid rim including a rigidly formed pocket;

the pocket having an open base and a latching surface;

a holder having a body with a front side, an aperture centrally positioned through the body, and a resilient engaging arm integrally formed with and extending from the body;

the engaging arm removably disposed within the pocket and extending through the open base;

a protective lens removably adhered to the front side;

a display card, bonded to the protective lens, for displaying the message through the aperture;

the engaging arm further comprising a catch detachably engaging the latching surface.

2. The apparatus of claim 1, wherein the hat includes a rigid dome and wherein the holder includes a concave surface adjacent the rigid dome.

3. The device of claim 1, wherein the display card further comprises an electronic identification chip for tracking the location of the display card.

4. The device of claim 1, further comprising at least two guiding arms, parallel to the engaging arm and disposed within the pocket.

* * * * *